US005483252A

United States Patent [19]

Shigeta

[11] Patent Number: 5,483,252

[45] Date of Patent: Jan. 9, 1996

[54] DRIVING APPARATUS OF PLASMA DISPLAY PANEL

[75] Inventor: Tetsuya Shigeta, Koufu, Japan

[73] Assignee: Pioneer Electronic Corporation, Tokyo, Japan

[21] Appl. No.: 207,743

[22] Filed: Mar. 9, 1994

[30] Foreign Application Priority Data

Mar. 12, 1993 [JP] Japan ..... 5-052357
Oct. 13, 1993 [JP] Japan ..... 5-255529

[51] Int. Cl.[6] ..... G09G 3/28

[52] U.S. Cl. ..... 345/67; 345/60; 345/68; 315/169.4

[58] Field of Search ..... 345/60, 67, 68, 345/69, 70, 61, 62; 315/169.1, 169.2, 169.4

[56] References Cited

U.S. PATENT DOCUMENTS 4,737,687 4/1988 Shinoda ..... 345/60
5,154,414 10/1992 Sano ..... 345/60
5,162,701 11/1992 Sano ..... 345/208

*Primary Examiner*—Richard Hjerpe
*Assistant Examiner*—Xiao M. Wu
*Attorney, Agent, or Firm*—Sughrue, Mion, Zinn, Macpeak & Seas

[57] ABSTRACT

A driving apparatus of a plasma display panel in which a writing cycle of pixel data is short. A pixel data pulse of a predetermined polarity is applied to column electrodes in accordance with pixel data, and scan pulses of a polarity opposite to the predetermined polarity are added to a maintenance pulse train in an interval between maintenance pulses of the same polarity as that of the pixel data pulse and the maintenance pulse train is applied to row electrodes.

5 Claims, 12 Drawing Sheets

DRIVING APPARATUS OF PLASMA DISPLAY PANEL

BACKGROUND OF THE INVENTION

1. Field of the Invention

The invention relates to driving apparatus of plasma display panel.

2. Description of Background Information

As is well known, various studies are being made recently on a plasma display as one of two-dimensional image displays of flat panel type. A plasma display panel of AC discharge type matrix system having a memory function is known as one of them.

In a driving apparatus of the conventional plasma display panel, since the discharge is caused only at a row of display cells to which a scan pulse is applied, it is necessary to limit a period of time to apply a pixel data pulse, therefore, there is a problem that a relatively long period is needed to write image data.

OBJECT AND SUMMARY OF THE INVENTION

The invention is made to solve such a problem and it is an object of the invention to provide a driving apparatus of a plasma display panel in which the period of each cycle to write pixel data is reduced without reducing the pulse widths of the scan pulse and maintenance pulse.

According to the present invention, there is provided a driving apparatus of a plasma display panel of the AC discharge type matrix system comprising a plurality of row electrode pairs arranged so that every two row electrodes make a pair and a plurality of column electrodes arranged in the direction which crosses perpendicularly to the row electrode pairs, wherein the driving apparatus comprises: pixel data pulse generating means for applying a pixel data pulse of a predetermined polarity to the column electrode in accordance with pixel data; and electrode driving means for adding a scan pulse having a polarity opposite to the predetermined polarity for an interval between maintenance pulses of the same polarity as the predetermined polarity and for applying to the row electrode pairs.

The pixel data pulse of the predetermined polarity is applied to the column electrode in accordance with the pixel data, the scan pulse of the polarity opposite to the predetermined polarity is added for an interval between the maintenance pulses of the same polarity as that of the pixel data pulse and is applied to the row electrodes.

DETAILED DESCRIPTION OF THE EMBODIMENT

Figure 1:
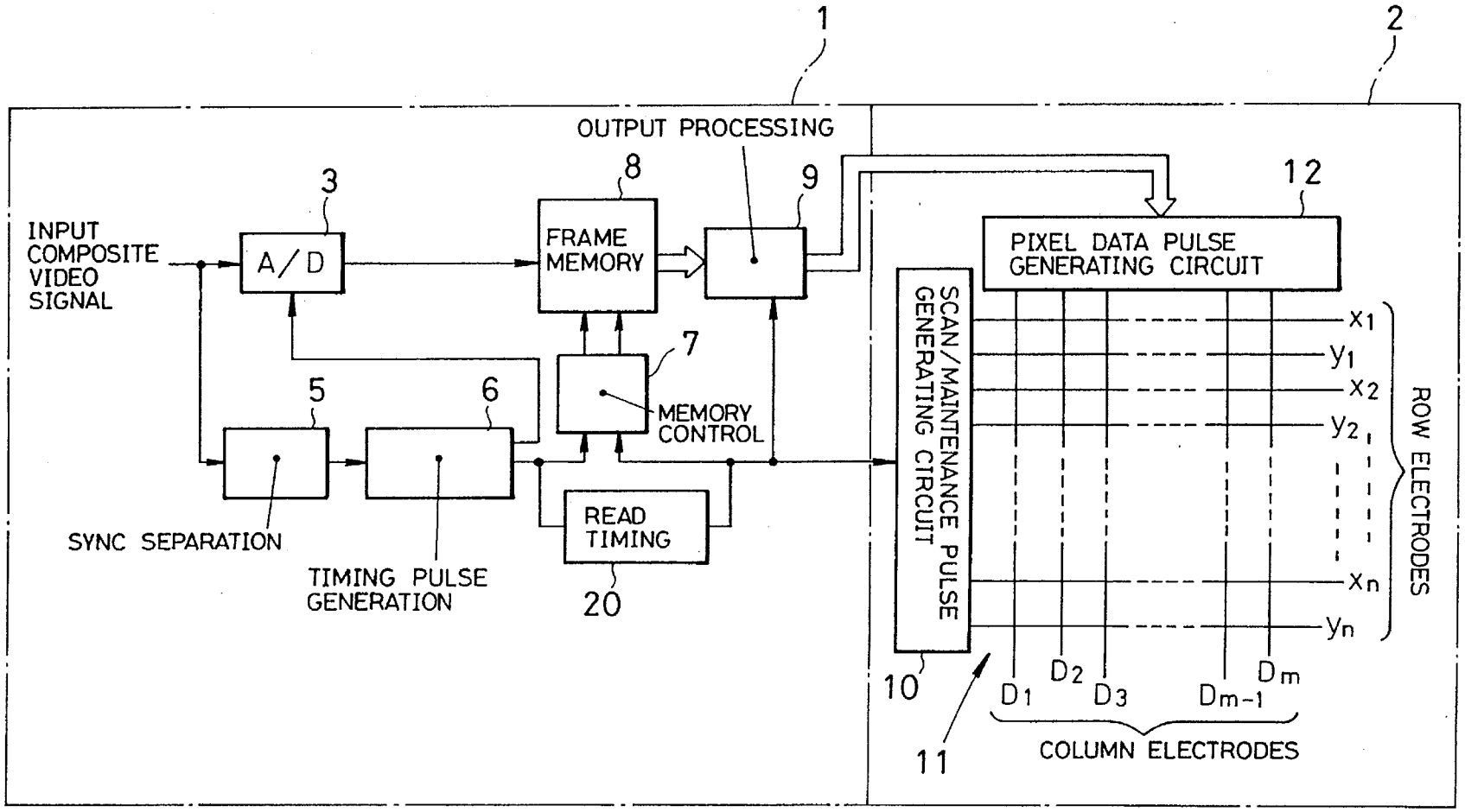
FIG. 1 is a diagram showing a construction of a display apparatus including a plasma display panel.

Before starting the explanation of an embodiment, a display apparatus including a conventional plasma display panel will be described with reference to the drawings. FIG. 1 shows a construction of such a display apparatus.

The display apparatus comprises: a signal processing section 1 to process a so called composite video signal as an input signal; and a display section 2 to display a two-dimensional image plane by receiving a driving signal from the signal processing section 1. In the signal processing section 1, an A/D converter 3 converts the input composite video signal to the pixel data of, for example, eight bits. On the other hand, a timing pulse generating circuit 6 generates various timing pulses on the basis of horizontal and vertical sync signals extracted from the input composite video signal by a sync separating circuit 5. The A/D converter 3 operates synchronously with the timing pulses. A memory control circuit 7 supplies write and read pulses synchronized with the timing pulse from the timing pulse generating circuit 6 to a frame memory 8, reads out the pixel data from the A/D converter 3 while sequentially fetching the pixel data from the A/D converter 3 into the frame memory 8 and supplies the read-out pixel data to an output processing circuit 9 at the next stage.

The output processing circuit 9 supplies the pixel data to a pixel data pulse generating circuit 12 synchronously with the timing pulse from the timing pulse generating circuit 6.

A plasma display panel 11 comprises column electrodes D1, D2, D3 . . . Dm-1, Dm and row electrodes x1, x2, x3, x4 . . . xn and y1, y2, y3, y4 . . . yn-1, yn in which one row is constructed by a pair of electrodes x and y. Each of the column electrodes and row electrodes is constructed so as to sandwich a dielectric material (not shown).

A scan/maintenance pulse generating circuit 10 applies scan pulses each having a potential to start the discharging in response to the timing pulse from the timing pulse generating circuit 6 to the row electrodes x1 to xn of the plasma display panel 11. Further, the scan/maintenance pulse generating circuit 10 generates maintenance pulses each having a potential to maintain a discharging state in response to the timing pulse from the timing pulse generating circuit 6 and applies the maintenance pulses to the row electrodes y1 to yn and row electrodes x1 to xn of the plasma display panel 11, respectively. In this instance, the maintenance pulses are applied to the (x) and (y) electrodes at timings which are deviated from each other.

On the other hand, the pixel data pulse generating circuit 12 generates pixel data pulses according to each pixel data which is supplied from the output processing circuit 9 and applies them to the column electrodes D1 to Dm.

A driving operation of the plasma display panel 11 having the above construction will now be described with reference to FIG. 2.

The pixel data pulse generating circuit 12 applies the pixel data pulse of the positive polarity according to the pixel data of each row unit to the column electrodes D1 to Dm. The scan/maintenance pulse generating circuit 10 applies a maintenance pulse IA of the negative polarity to each of the row electrodes y1 to yn at the same timing. The scan/maintenance pulse generating circuit 10 further applies a maintenance pulse IB of the negative polarity to each of the row electrodes x1 to xn at the same timing and also applies a scan pulse SP of the negative polarity synchronously with the above-mentioned timing of application of the pixel data pulse in a period of time when none of the maintenance pulses IA and IB is applied.

In the diagram, the scan pulse SP the and the pixel data pulse are simultaneously applied to the row electrode x1 of the first row at a time point $t_1$. In this instance, since a potential difference of the scan pulse SP and the pixel data pulse exceeds a discharge start voltage, a discharge causing emission of light occurs at the first row. Since the pixel data pulse of the positive polarity is applied in an interval where no maintenance pulse is applied to either of the (x) and (y) electrodes of each row, the discharge will not occur in rows other than the first row at the time point $t_1$. That is, the pixel data can be written only to the "row" to which the scan pulse SP is applied.

Although the discharge at the time point $t_1$ mentioned above is finished instantaneously, the potential by the scan pulse SP and the pixel data pulse is applied for a predetermined time even after the discharge has been finished. Therefore, the charges generated by the discharge mentioned above remain on the border between the dielectric material and the electrode and form wall charges. Since the wall charges exist in the dielectric material, the discharge occurs again at voltage lower than the discharge start voltage mentioned above. After completion of the discharge by the scan pulse SP, consequently, the discharge and emission of light again occur in the first row due to the maintenance pulse IA which is applied to the (y) electrode at a time point $t_2$. In this instance, the re-discharge is also finished instantaneously. However the discharge and emission of light again occur in the first row due to the maintenance pulse IB which applied to the electrode x1 at a point of time $t_3$. Since the above-described operations occur repeatedly as shown in the diagram, the discharge occurs repeatedly and a light emitting state of the pixel is maintained.

As mentioned above, in the driving apparatus of the conventional plasma display panel, since the discharge occurs only in the "row" to which the scan pulse SP is applied, the pixel data pulse is applied for a period of time when no maintenance pulse is applied to any of the (x) and (y) electrodes of each row.

Figure 2:
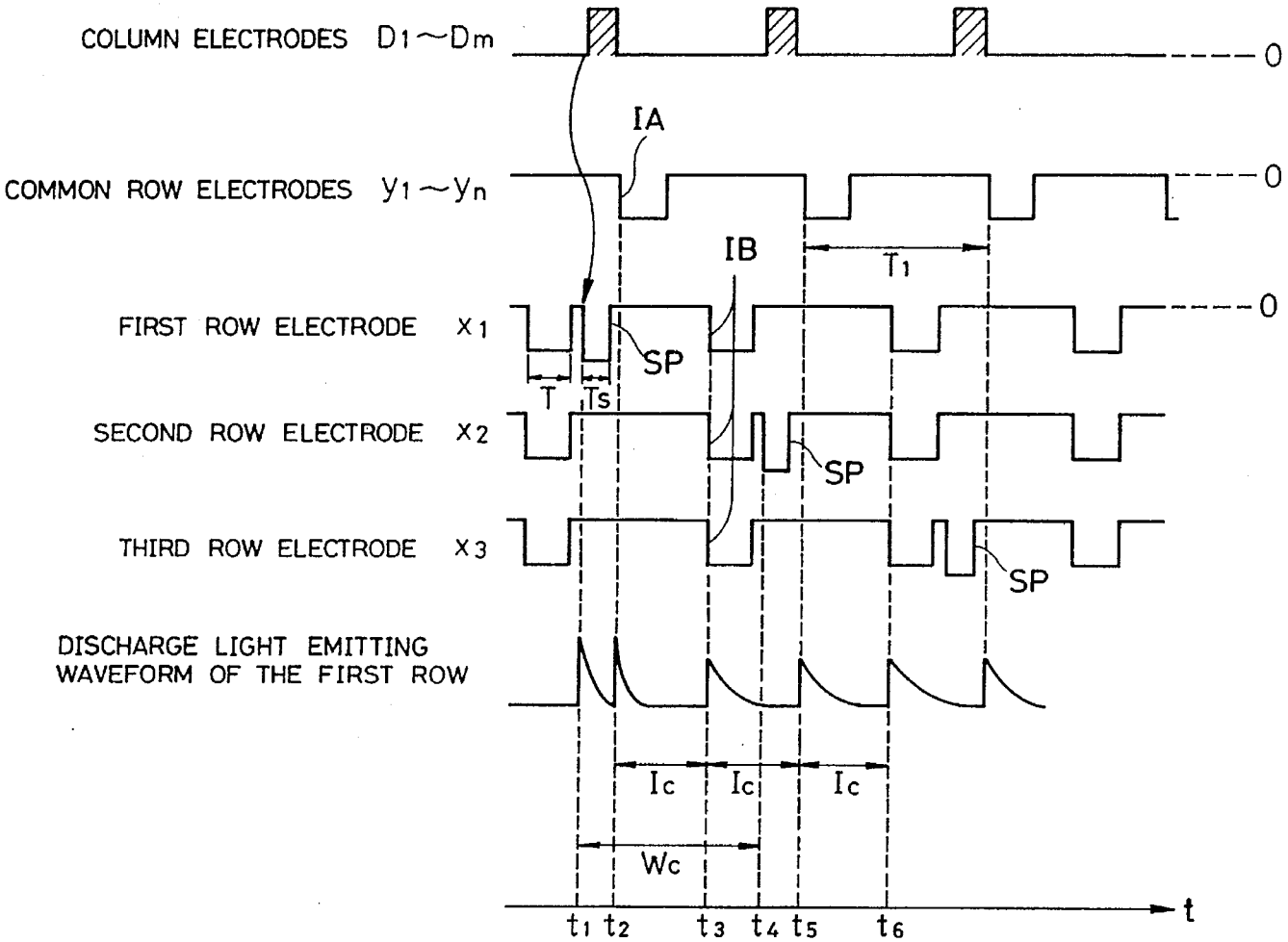
FIG. 2 is an operation waveform diagram according to a driving apparatus of a conventional plasma display panel.

Therefore, as shown in FIG. 2, in order to execute the writing operation of the pixel data of the second row at a time point $t_4$ after the writing of the pixel data of the first row at the time point $t_1$ has been finished, a write cycle time (Wc) longer than the sum of the pulse width $T_s$ of the scan pulse SP and a period twice the pulse width T of the maintenance pulse is needed. This has been causing a problem that a long time is needed to write the image data.

Furthermore, when the method shown in FIG. 2 is employed and the generation of images of improved resolution is attempted by increasing the number of gradation degrees and/or the number of scanning lines, the period of write cycle (Wc) should be shortened sufficiently. However, to assure that the discharge operation for one line (row) is performed in a stable manner, the pulse width $T_s$ of the scan pulse SP cannot be shortened excessively and it must be greater than a predetermined time period (e.g., 4μ seconds). The pulse width T of the maintenance pulse also cannot be shortened excessively because the wall charge must be accumulated more than a predetermined value so that the maintenance discharge is performed stably.

An embodiment of the invention will now be described hereinbelow.

Figure 3:
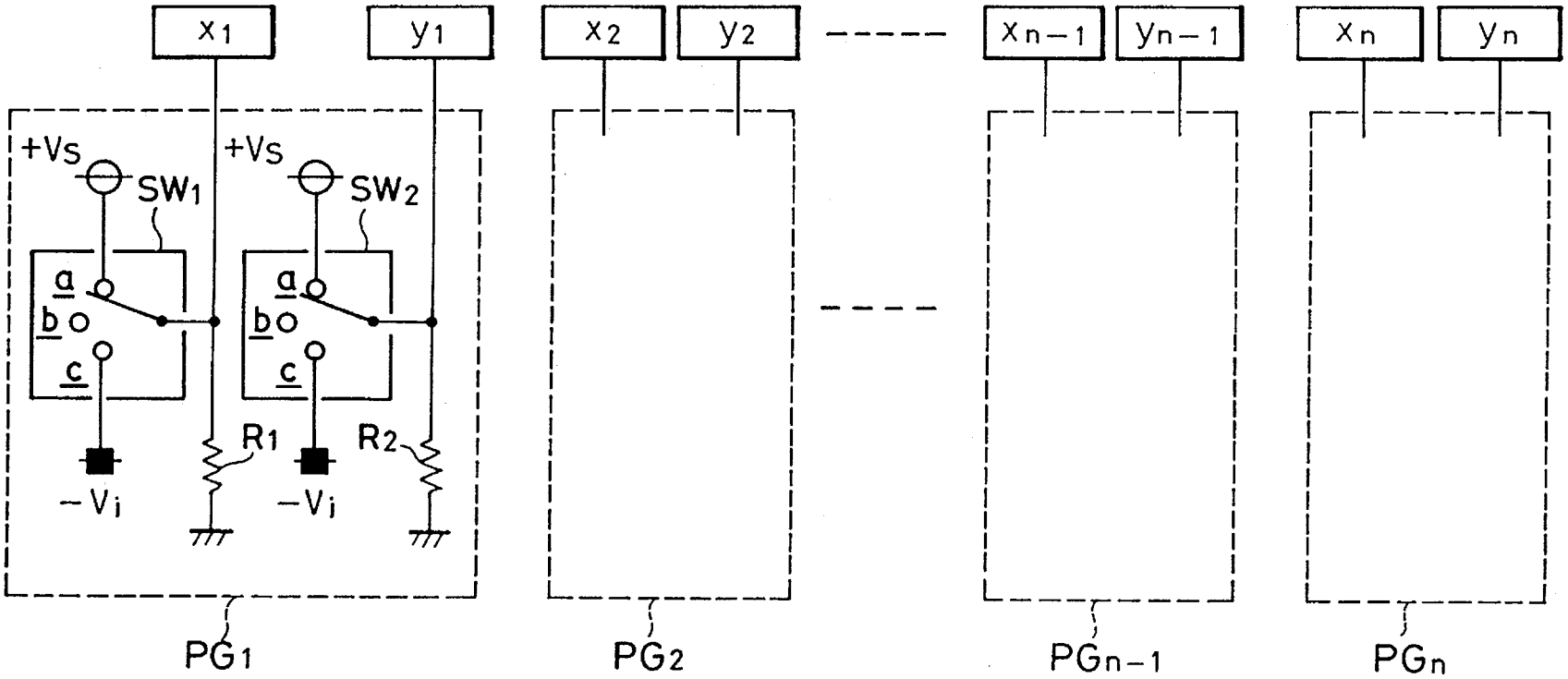
FIG. 3 is a diagram showing a construction of a driving apparatus of a plasma display panel of the present invention.
Figure 4:
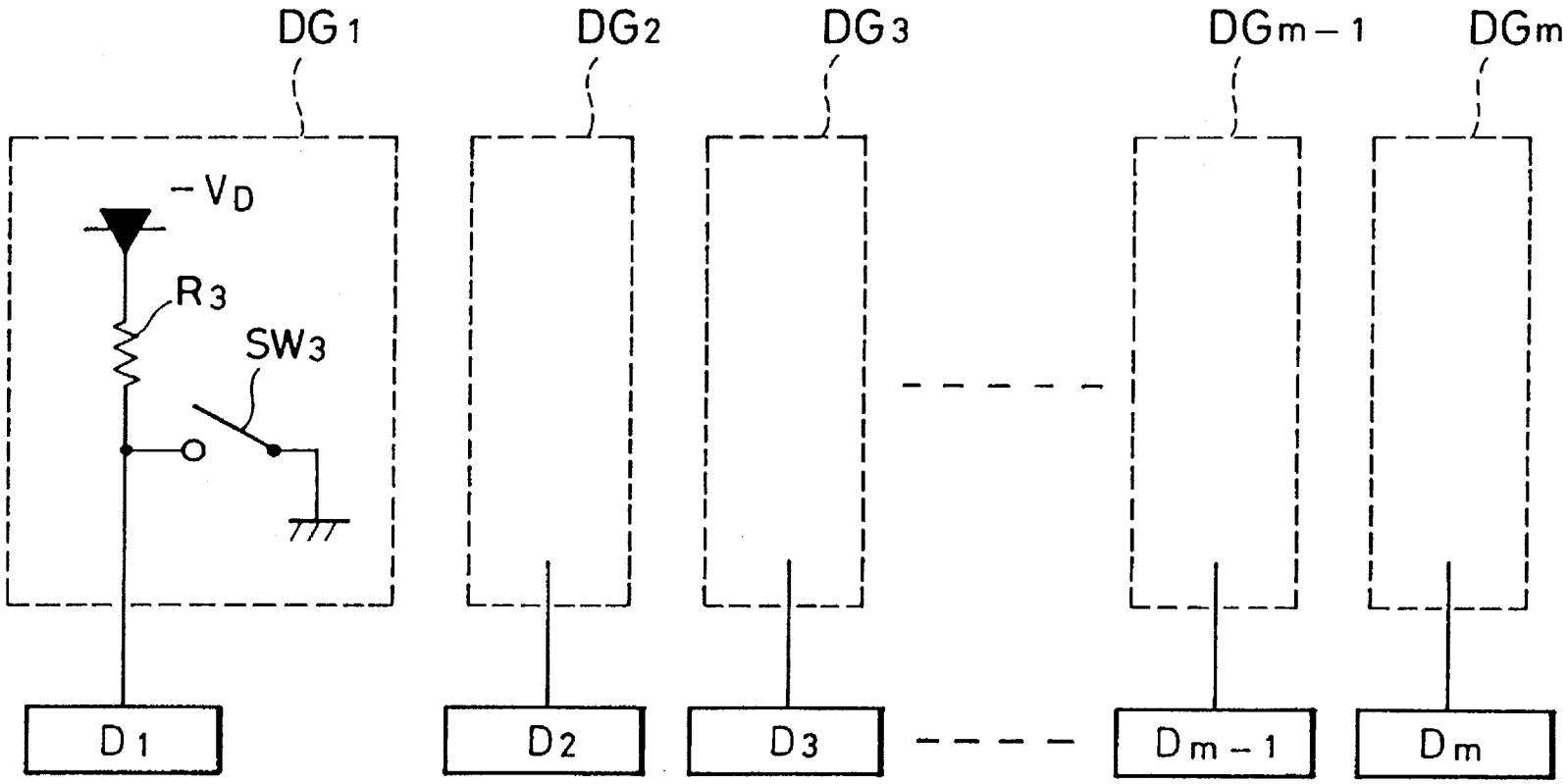
FIG. 4 is a diagram showing a construction of the driving apparatus of the plasma display panel of the invention.

FIGS. 3 and 4 are diagrams showing a construction of the driving apparatus of the plasma display panel according to the invention.

FIG. 3 shows a scan/maintenance pulse generating circuit which applies the scan pulses and maintenance pulses to the row electrodes of the plasma display panel.

In the diagram, scan/maintenance pulse generators PG1 to PGn each having the same function are provided for every row electrodes (x, y) and the scan/maintenance pulse generator will now be described hereinbelow.

A potential +Vs of the positive polarity to cause a discharge is applied to a stationary contact a of a switch SW1. A potential −Vi of the negative polarity to maintain the discharge is applied to a stationary contact c of the switch SW1. A stationary contact b of the switch SW1 is a non-connected terminal. A GND potential is applied through a resistor R1 to a movable contact of the switch SW1 and further the (x) electrode is connected to the movable contact. In the above construction, when the movable contact and the stationary contact a of the switch SW1 are connected, the scan pulse SP of the potential +Vs is applied to the (x) electrode and when the movable contact and the stationary contact c of the switch SW1 are connected, the maintenance pulse IB of the potential −Vi is applied to the (x) electrode. Further when the movable contact and the stationary contact b of the switch SW1 are connected, the GND potential is applied to the (x) electrode.

The potential +Vs of the positive polarity to cause a discharge is applied to a stationary contact a of a switch SW2, and the potential −Vi of the negative polarity to maintain the discharge is applied to a stationary contact c of the switch SW2. A stationary contact b of the switch SW2 is a non-connected terminal. The GND potential is applied to a movable contact of the switch SW2 through the resistor R1 and, further, the (y) electrode is connected to the movable contact. In the above construction, when the movable contact and the stationary contact a of the switch SW2 are connected, the scan pulse SP of the potential +Vs is applied to the (y) electrode. When the movable contact and the stationary contact c of the switch SW2 are connected, the maintenance pulse IA of the potential −Vi is applied to the (y) electrode. Further, when the movable contact and the stationary contact b of the switch SW2 are connected, the GND potential is applied to the (y) electrode.

The scan/maintenance pulse generating circuit having such a construction is provided for every row electrode as shown in the diagram.

FIG. 4 shows a pixel data pulse generating circuit to apply pixel data pulses to the column electrodes of the plasma display panel.

In the diagram, pixel data pulse generators DG1 to DGm having the same function are provided for every column electrode. The pixel data pulse generator will now be described hereinbelow.

A potential –VD of the negative polarity is applied to the column electrode through a resistor R3. Further, the GND potential is applied to the column electrode through a switch SW3.

In the above construction, the switch SW3 enters an open state when the logic of the pixel date to be supplied is equal to "1" and applies the pixel data pulse of the potential –VD to the column electrode. When the logic of the pixel data to be supplied is equal to "0" or when no pixel data is applied, the switch SW3 enters a closing state and applies the GND potential to the column electrode.

Figure 5:
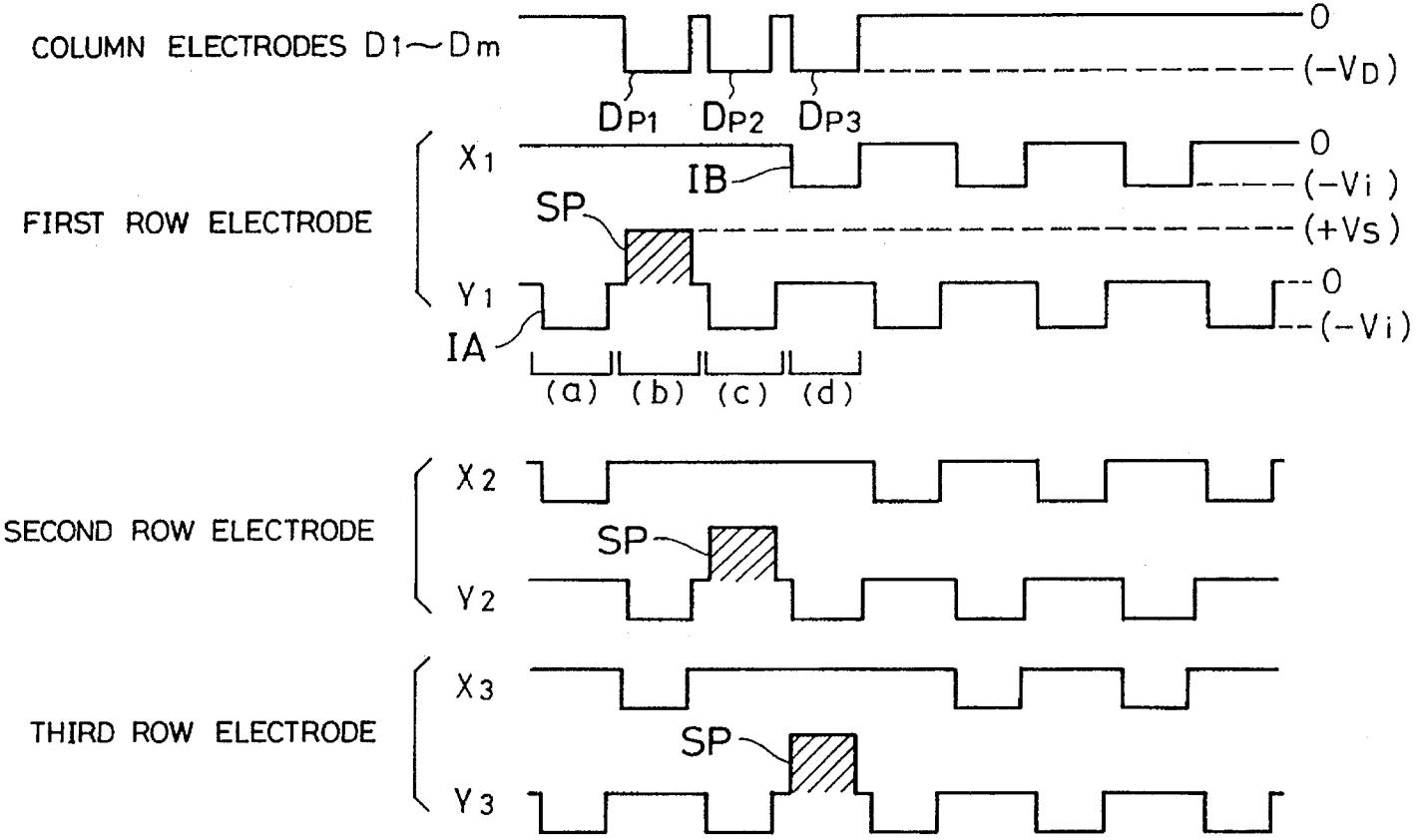
FIG. 5 is an operation waveform diagram according to the driving apparatus of the plasma display panel of the invention.

FIG. 5 shows a diagram of operation waveforms in such a construction.

In FIG. 5, an example of the operation waveforms of three row electrodes are shown among the row electrodes y1 to yn and x1 to xn.

The operation of the first row electrode will now be described with reference to discharging operation transition diagrams shown in FIGS. 6 and 7. It is assumed that the pixel data which is supplied is always equal to logic "1".

Figure 6A:
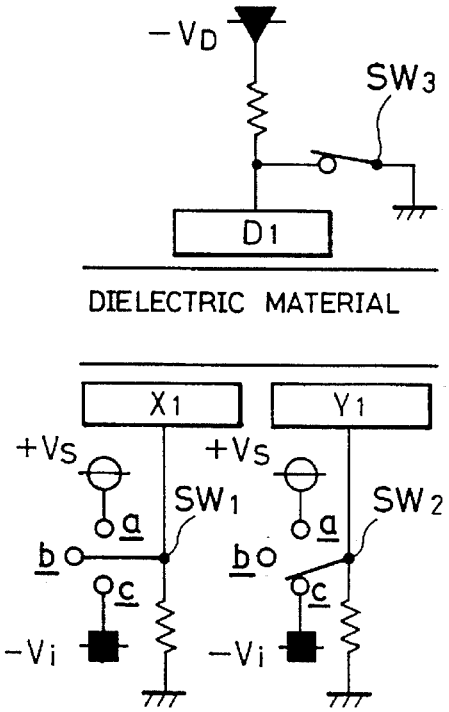
FIGS. 6A and 6B are diagrams showing a transition of a discharging state according to the driving apparatus of the plasma display panel of the invention.

First, in an interval (a) in FIG. 5, no pixel data is supplied and the maintenance pulse IA is applied to the y1 electrode. In this instance, as shown in FIG. 6A, the movable contact and the stationary contact b of the switch SW1 are connected, the movable contact and the stationary contact c of the switch SW2 are connected and the switch SW3 enters a closing state. In the interval (a) as mentioned above, since the potential –Vi due to the maintenance pulse IA is merely applied to the y1 electrode, the discharge doesn't occur in the dielectric material sandwiched by the column electrode and the row electrode as shown in FIG. 6A, and no wall charges is generated.

Figure 6B:
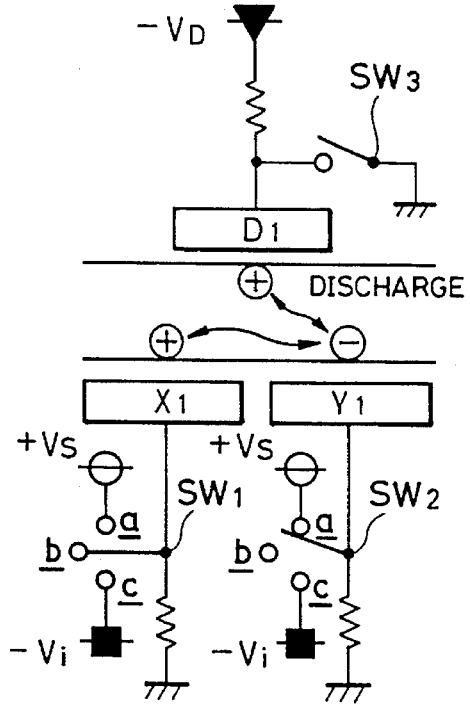

Subsequently, in an interval (b), pixel date is supplied and a pixel data pulse Dp1 according to the supply of the pixel data is applied to the column electrode. Further the scan pulse SP is applied to the y1 electrode. In this instance, as shown in FIG. 6B, the movable contact and the stationary contact b of the switch SW1 are connected, the movable contact and the stationary contact a of the switch SW2 are connected and the switch SW3 enters an open state. In the interval (b) as mentioned above, the potential –VD by the pixel data pulse Dp1 is applied to the column electrode, the potential +Vs due to the scan pulse SP is applied to the y1 electrode and a potential difference between the potentials +Vs and –VD applied exceeds the discharge start voltage. As shown in FIG. 6B, therefore, a discharge occurs between the row electrode and the y1 electrode. After the discharge was finished, negative wall charges remain on the border between the dielectric material and the y1 electrode. In this instance, since the GND potential is applied to the x1 electrode, positive wall charges remain on the border between the dielectric material and the x1 electrode. As mentioned above, the pixel data is written in the interval (b).

Figure 6C:
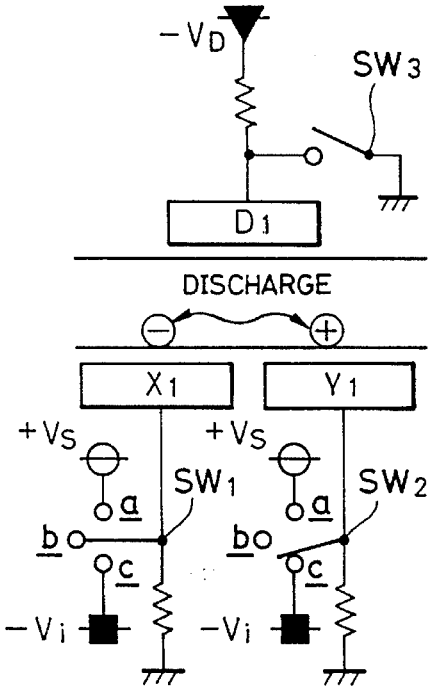
FIGS. 6C and 6D are diagrams showing a transition of a discharging state according to the driving apparatus of the plasma display panel of the invention.

In an interval (c), there is the pixel data is supplied and a pixel data pulse Dp2 according to the supply of the pixel data is applied to the column electrode. Further, the maintenance pulse IA is applied to the y1 electrode. In this instance, as shown in FIG. 6C, the movable contact and the stationary contact b of the switch SW1 are connected, the movable contact and the stationary contact c of the switch SW2 are connected and the switch SW3 enters an open state. In the interval (c), although the potential –VD by to the pixel data pulse Dp2 is applied to the column electrode, since the scan pulse SP is not applied to the y1 electrode, no discharge occurs between the column and the row electrodes (x and y) as shown in FIG. 6C. In this instance, however, the potential –Vi by the maintenance pulse IA is applied to the y1 electrode and the GND potential is applied to the x1 electrode, so that an electric field –Vi is applied between the y1 and x1 electrodes. A discharge consequently occurs between the y1 and x1 electrodes by a charge energy which the wall charges remaining in the interval (b) have and an energy by the electric field. After the discharge was finished, positive wall charges remain on the border of the dielectric material and the y1 electrode and negative wall charges remain on the border of the dielectric material and the x1 electrode.

Figure 6D:
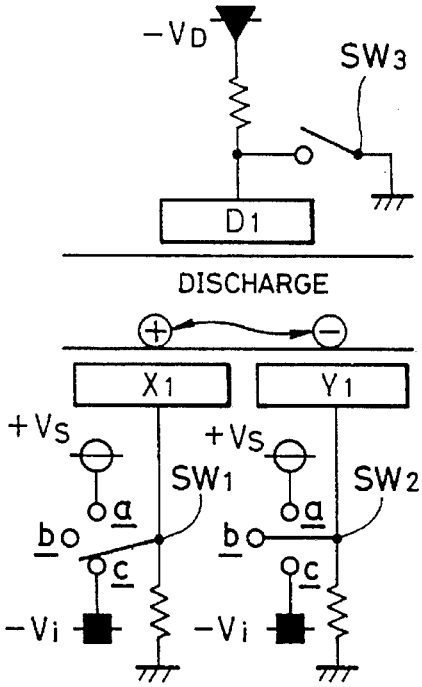

In an interval (d), pixel data is supplied and a pixel data pulse Dp3 according to the supply of the pixel data is applied to the column electrode. Further, the maintenance pulse IB is applied to the x1 electrode. In this instance, as shown in FIG. 6D, the movable contact and the stationary contact c of the switch SW1 are connected, the movable contact and the stationary contact b of the switch SW2 are connected and the switch SW3 enters an open state. In the interval (d), although the potential –VD due to the pixel data pulse Dp3 is applied to the column electrode, since no scan pulse SP is applied to the y1 electrode, no discharge occurs between the column and row electrodes (x and y) as shown in FIG. 6D. In this instance, however, since the potential –Vi due to the maintenance pulse IB is applied to the x1 electrode and the GND potential is applied to the x1 electrode, an electric field –Vi is applied between the x1 and y1 electrodes. Therefore, by a charge energy which the wall charges themselves remaining in the interval (c) have and the energy by the electric field have, a discharge occurs between the y1 and x1 electrodes. After the discharge was finished, positive wall charges remain on the border of the dielectric material and the x1 electrode and negative wall charges remain on the border of the dielectric material and the y1 electrode.

As mentioned above, the pixel data is written in the interval (b) in the first row. In the subsequent rows, a discharge light emitting state of the pixel data written in the interval (b) is held by the maintenance pulses which are alternately applied as shown in the intervals (c) and (d). The operation as mentioned above is likewise executed in each row electrodes of the second and subsequent rows, thereby writing pixel data on a row unit basis.

In the invention, it is assumed that the scan pulse SP has a voltage of the positive polarity opposite to the polarity of each of the maintenance pulses IA and IB and the pixel data pulse which is applied to the column electrode has a negative polarity. Therefore, since the pixel data pulse and the maintenance pulse have the same polarity, even when the "row" to which both of those pulses are applied at the same timing exists, no discharge occurs in such a "row".

As shown in FIG. 5, therefore, after the writing to the first row was finished in the interval (b), the writing of the second row can be performed in the next interval (c). The writing of the next row can be executed without waiting for the discharge maintaining cycle (Ic) in FIG. 2.

As explained in the foregoing, the plasma display driving apparatus according to the present invention is configured that the scan pulse can be applied to a row electrode to which the writing of pixel data is targeted, in a period when the maintenance pulse is applied to a row electrode to which the writing of pixel data is not targeted. By this feature, the reduction of the period of the writing cycle of pixel data is enabled.

Figure 7:
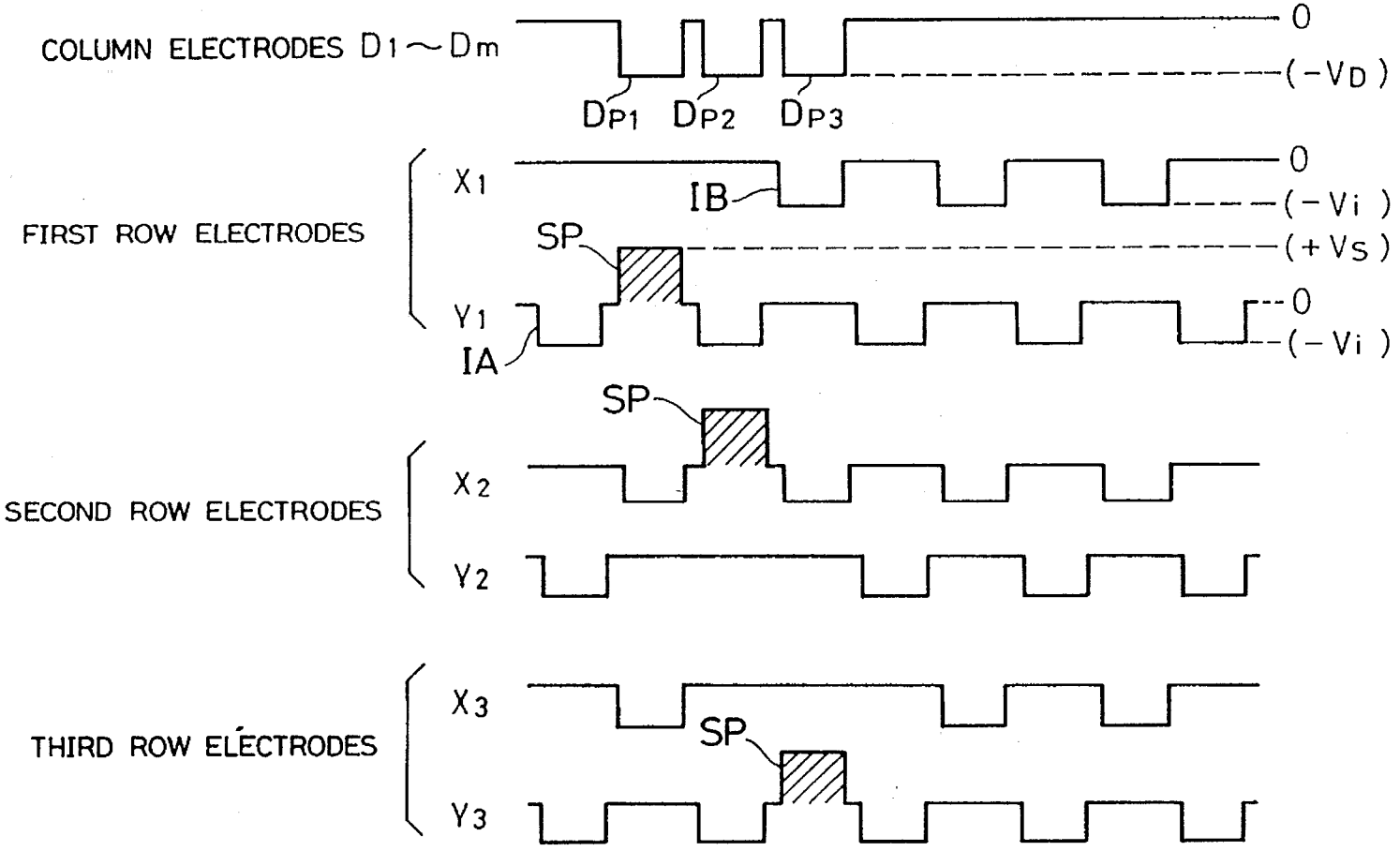
FIG. 7 is an operation waveform diagram of another embodiment according to the driving apparatus of the plasma display panel of the invention.

FIGS. 5 and 7 are drawn as if the leading edge timings between the scan pulse SP and pixel data pulse and the maintenance pulse which is applied to each row electrode (that is, the apply start timings of the scan pulse SP and each maintenance pulse) are identical. When the leading edge timings of the scan pulse SP and pixel data pulse and the maintenance pulse coincide, however, there is a case where abnormality occurs in the discharging state due to a mutual interference between the rows. The leading edge timings of the scan pulse SP and pixel data pulse and the each maintenance pulse are actually deviated to a certain extent so that the discharge state abnormality due to the mutual interference between the rows doesn't occur.

Figure 8:
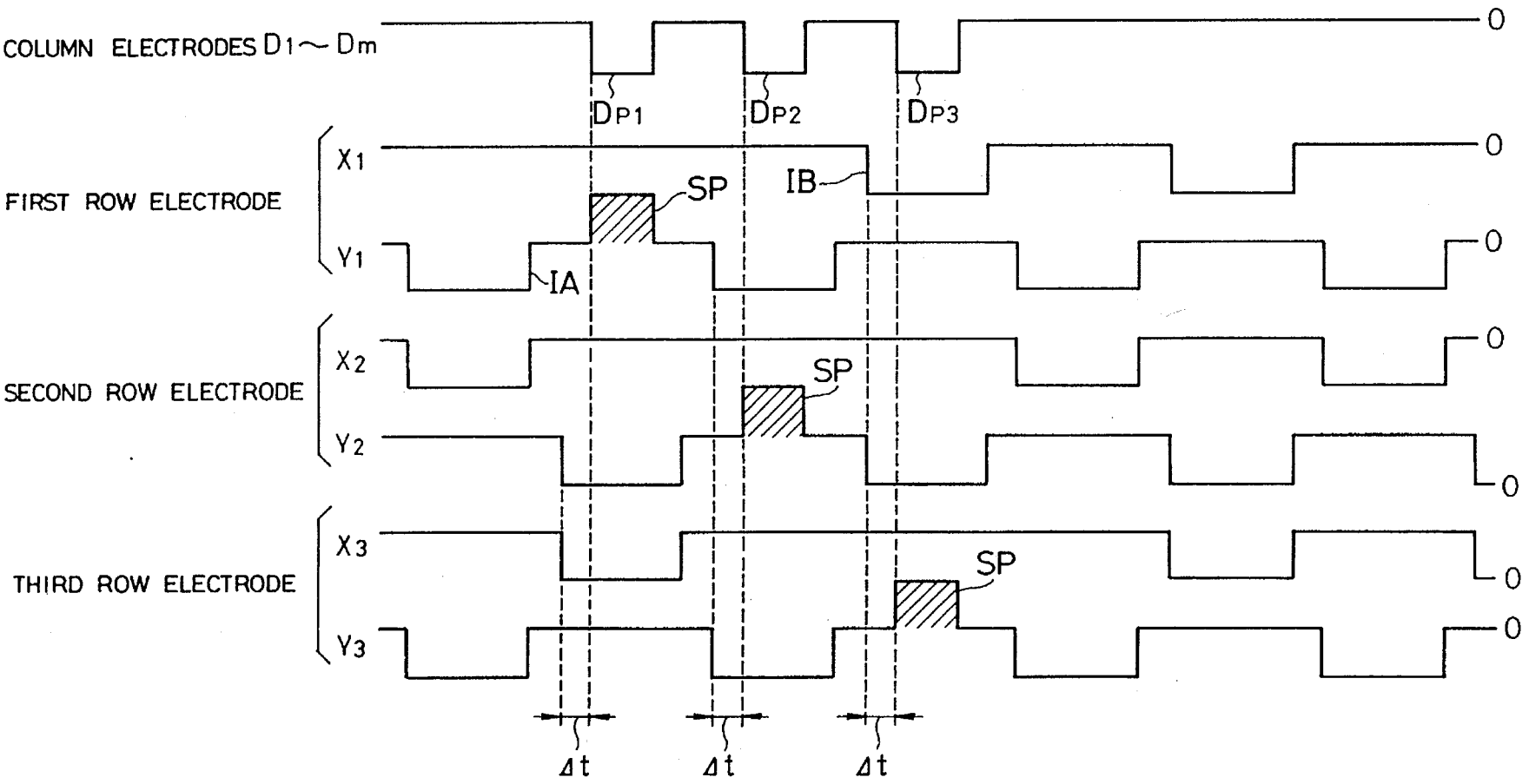
FIG. 8 is an operation waveform diagram according to the driving apparatus of the plasma display panel of the invention.
Figure 9:
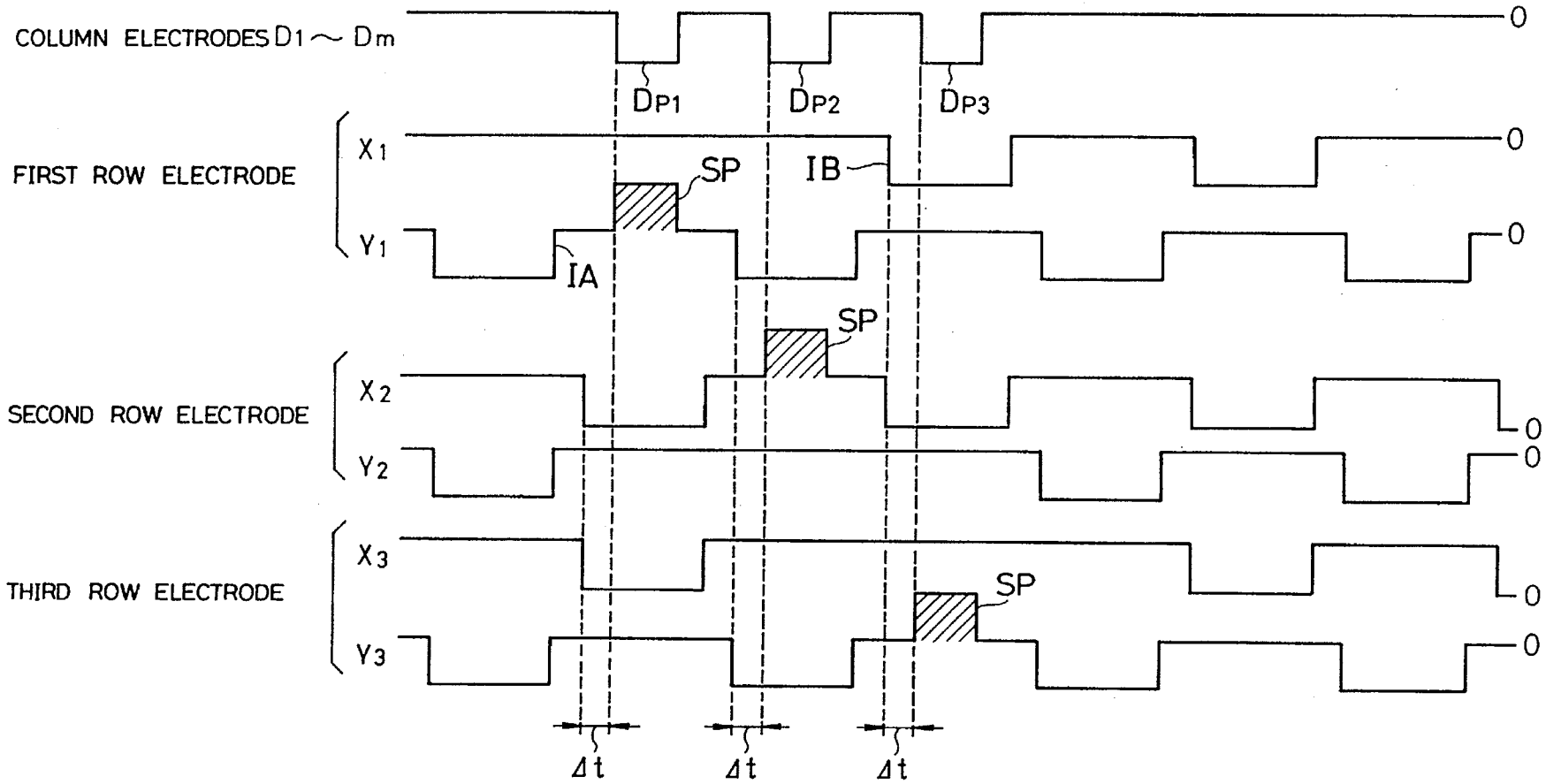
FIG. 9 is an operation waveform diagram according to the driving apparatus of the plasma display panel of the invention.

FIGS. 8 and 9 are diagrams showing operation waveforms in consideration of the points as mentioned above in FIGS. 5 and 7. FIGS. 8 and 9 show examples in which the leading edge timings of the scan pulse SP and pixel data pulse and the maintenance pulse which is applied to each row electrode are deviated by only time $\Delta t$ during which a discharge state abnormality due to the mutual interference between the rows doesn't occur.

Although the scan pulse SP of the first row electrode has been applied to the (y) electrode in the above embodiment, it can be also applied to the (x) electrode. The electrode to which the scan pulse SP is applied is not limited to either one of the (x) and (y) electrodes, but it is possible to apply the scan pulse SP alternately to (x) and (y) electrodes by switching every neighboring rows as shown in FIG. 7.

Further, in the embodiments of FIGS. 5 and 7, it is assumed that the polarity of the scan pulse is positive and the polarity of the pixel data pulse is negative and the polarity of the maintenance pulse is negative. It is also possible to set that the polarity of the scan pulse is negative and the polarity of the pixel data pulse is positive and the polarity of the maintenance pulse is positive.

In the embodiments shown in FIGS. 5 and 7 described above, the pixel data is written to the row electrode by the scan pulse SP. Furthermore, elimination of pixel data written in the row electrode can also be executed by reducing the pulse width of the scan pulse SP. To implement such a scheme, an erase pulse EP having a narrower pulse width than the scan pulse SP can be produce as illustrated in FIG. 10, by shortening the time period in which the movable contact of the switch SW1 or SW2 shown in FIG. 3 is connected to the stationary contact a.

Figure 10:
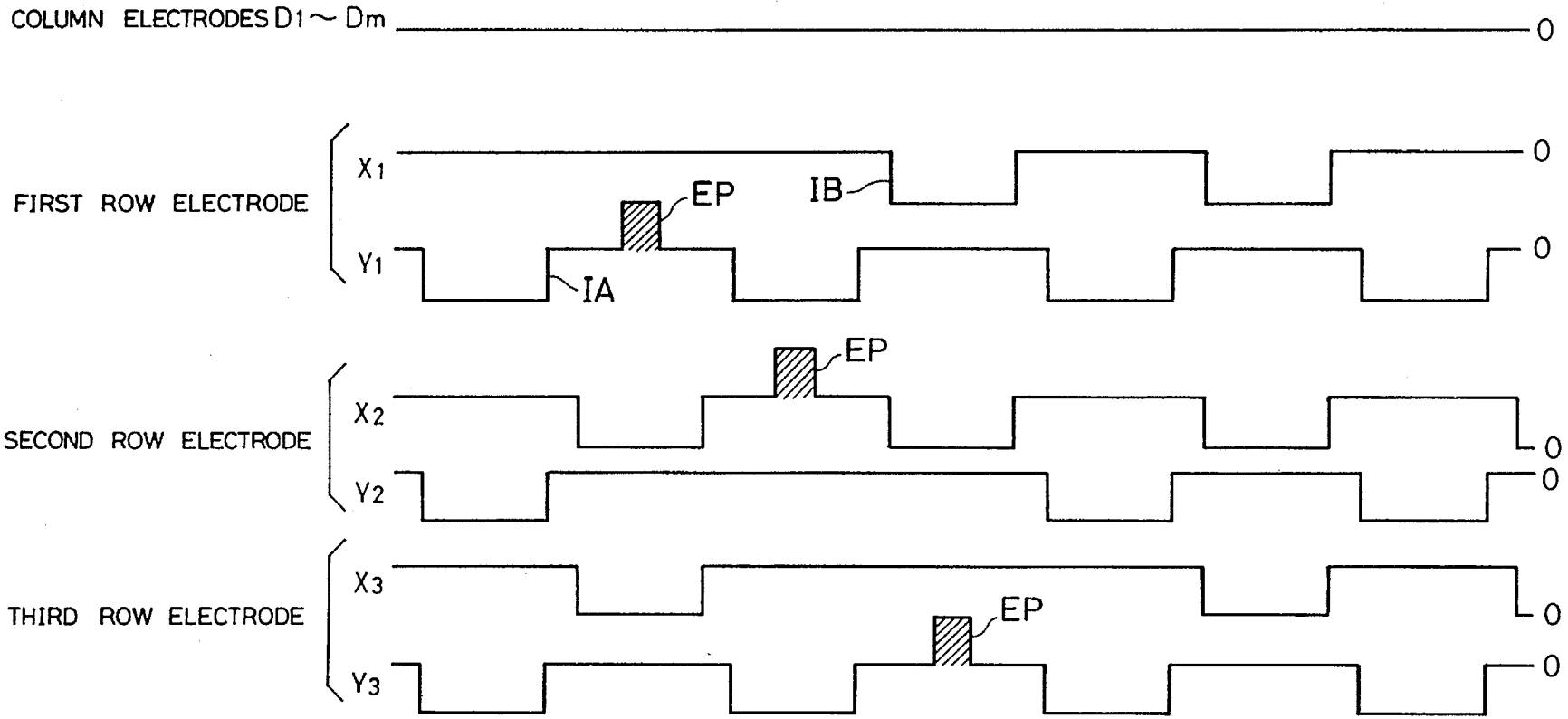
FIG. 10 is an operation waveform diagram of erase pulses EP according to the driving apparatus of the plasma display panel of the invention.

In such a scheme, the pixel data is written in each row electrode at the timing of the supply of the scan pulse SP, and the pixel data written in each row electrode is erased by the erase pulse EP shown in FIG. 10.

Furthermore, in the embodiment shown in FIG. 10, an erase pulse of a polarity opposite to the polarity of the maintenance pulse is applied to the row electrode. However, to effect the elimination of the pixel data it is also possible that the polarity of the erase pulse is the same as the polarity of the maintenance pulse.

Figure 11:
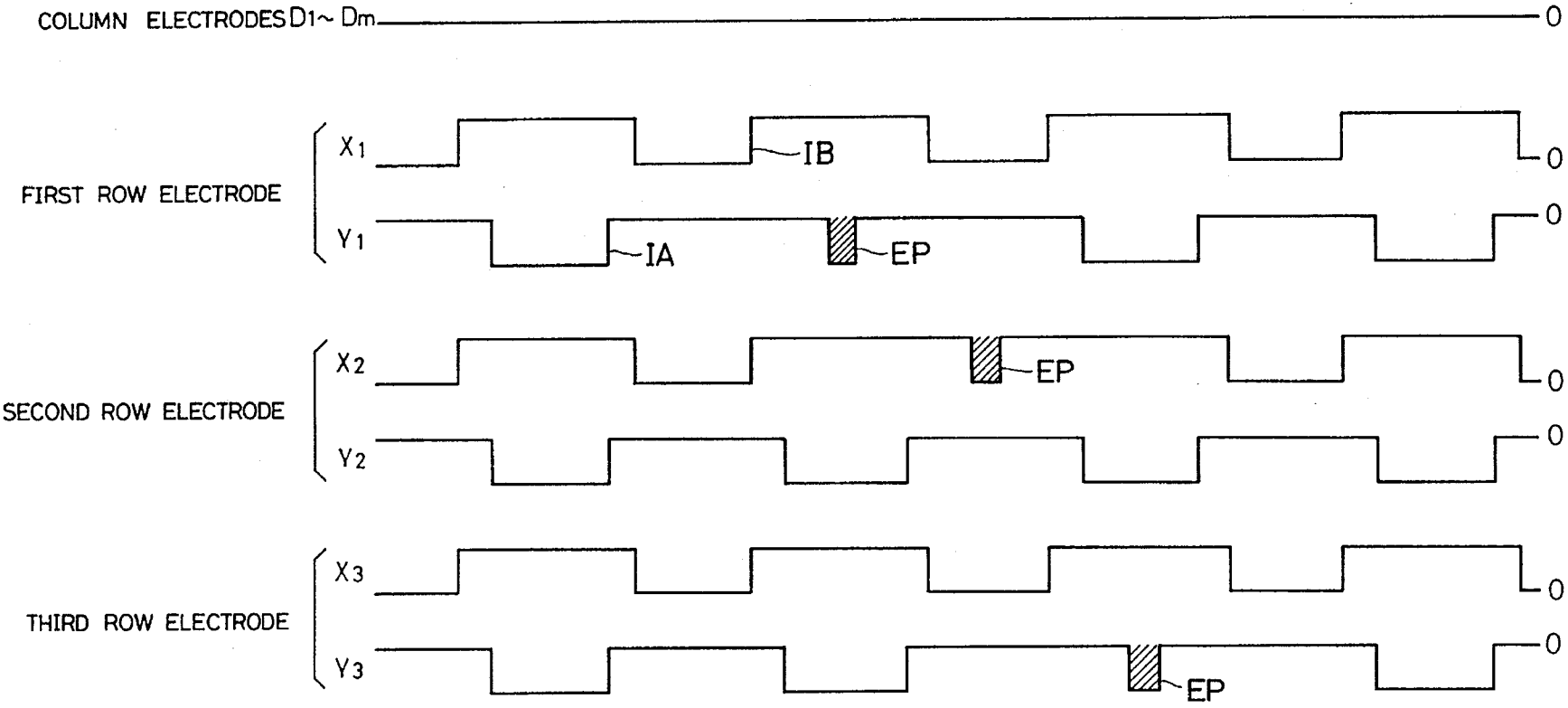
FIG. 11 is an operation waveform diagram of erase pulses EP according to the driving apparatus of the plasma display panel of the invention.

FIG. 11 shows an example of waveforms in a case in which erase of the pixel data is performed by applying an erase pulse of the same polarity as the maintenance pulse.

As will be understood from the foregoing description, the driving apparatus of the plasma display panel according to the invention has a construction that the pixel data pulse of a predetermined polarity is applied to the column electrode in accordance with the pixel data and the scan pulse of the polarity opposite to the predetermined polarity is added for an interval between the maintenance pulses of the same polarity as that of the pixel data pulse and is applied to the row electrode.

According to the driving apparatus of the plasma display panel of the invention, therefore, since no discharge occurs even when the pixel data pulse and the maintenance pulse are applied at the same timing, the pixel data pulse can be applied for a period of time when the maintenance pulse is applied to the electrodes which are in a mode other than the writing mode, so that the period of the writing cycle of the pixel data is reduced without shortening the pulse widths of the scan pulse and the maintenance pulse.

What is claimed is:

1. A driving apparatus of a plasma display panel of an AC discharge type matrix system comprised of a plurality of row electrode pairs arranged so that every two rows make a pair and a plurality of column electrodes arranged in the direction which crosses perpendicularly to the row electrode pairs, comprising:

pixel data pulse generating means for applying a pixel data pulse train having pixel data pulses of a predetermined polarity to said column electrodes in accordance with pixel data; and electrode driving means for adding, to a maintenance pulse train, scan pulses of a polarity opposite to said predetermined polarity in intervals between maintenance pulses of a same polarity as said predetermined polarity, said scan pulses being generated at timings to coexist with each of said pixel data pulses, and for applying said maintenance pulse train with said scan pulses added thereto to said row electrode pairs.

2. A driving apparatus according to claim 1, wherein said pixel data pulses and said scan pulses are applied to said column electrodes and said row electrodes respectively at timings which are delayed by a predetermined time from a start timing of application of the maintenance pulse to any one of said row electrodes.

3. A driving apparatus according to claim 1, wherein said electrode driving means applies said scan pulse to one electrode in each row electrode pair of said row electrode pairs in a period in which said maintenance pulse is not applied to the other electrode in said each electrode pair of said row electrode pairs.

4. A driving apparatus according to claim 1, wherein said electrode driving means adds, to said maintenance pulse train, erase pulses of a polarity opposite to said predetermined polarity in intervals between maintenance pulses of a same polarity as said predetermined polarity and applies said maintenance pulse train with said erase pulses added thereto to said row electrode pairs.

5. A driving apparatus as claimed in claim 1, wherein each of said scan pulses is added to said maintenance pulse train for one of said row electrode pair, in a period generally the same as a period in which one of said maintenance pulses is generated for another one of said electrode pairs.

* * * * *